US008586809B2

(12) United States Patent
Beech, Jr. et al.

(10) Patent No.: US 8,586,809 B2
(45) **Date of Patent: *Nov. 19, 2013**

(54) PURIFICATION OF TRANSALKYLATION FEEDSTOCK

(75) Inventors: James H. Beech, Jr., Kingwood, TX (US); Julia E. Steinheider, Houston, TX (US); Doron Levin, Highland Park, NJ (US); Selma S. Lawrence, Houston, TX (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 193 days.

This patent is subject to a terminal disclaimer.

(21) Appl. No.: 13/183,009

(22) Filed: Jul. 14, 2011

(65) Prior Publication Data

US 2012/0024755 A1 Feb. 2, 2012

Related U.S. Application Data

(60) Provisional application No. 61/369,399, filed on Jul. 30, 2010.

(51) Int. Cl.

| | |
|---|---|
| ***C07C 6/12*** | (2006.01) |
| ***C07C 4/18*** | (2006.01) |
| ***C07C 4/02*** | (2006.01) |

(52) U.S. Cl.

USPC ..... 585/319; 585/475; 585/470; 585/483; 585/488; 585/489

(58) Field of Classification Search

USPC ..... 585/319, 475, 470, 483, 488, 489

See application file for complete search history.

(56) References Cited

U.S. PATENT DOCUMENTS

| | | | | |
|---|---|---|---|---|
| 5,030,787 | A | 7/1991 | Absil et al. | |
| 5,107,061 | A | 4/1992 | Ou et al. | |
| 5,942,651 | A | 8/1999 | Beech, Jr. et al. | |
| 6,297,417 | B1 * | 10/2001 | Samson et al. | 585/448 |
| 7,154,014 | B1 | 12/2006 | Negiz et al. | |
| 2007/0042905 | A1 | 2/2007 | Negiz et al. | |
| 2007/0086933 | A1 | 4/2007 | Negiz et al. | |
| 2008/0161622 | A1 * | 7/2008 | Frey et al. | 585/470 |
| 2010/0298117 | A1 | 11/2010 | Levin et al. | |

FOREIGN PATENT DOCUMENTS

| | | |
|---|---|---|
| EP | 0 177 195 | 4/1986 |

OTHER PUBLICATIONS

U.S. Appl. No. 12/973,331, filed Dec. 20, 2010, "*Transalkylation of Heavy Aromatic Hydrocarbon Feedstocks*", Cao et al.

U.S. Appl. No. 12/973,358, filed Dec. 20, 2010, "*Transalkylation of Heavy Aromatic Hydrocarbon Feedstocks*", Levin et al.

* cited by examiner

*Primary Examiner* — Thuan D Dang

(74) *Attorney, Agent, or Firm* — Andrew B. Griffis

(57) ABSTRACT

A guard bed or absorber is placed upstream of a transalkylation reactor to avoid deposition of halide and/or halogen species on the catalysts in said reactor.

20 Claims, 1 Drawing Sheet

PURIFICATION OF TRANSALKYLATION FEEDSTOCK

PRIORITY CLAIM

This application claims the benefit of U.S. Provisional Application No. 61/369,399, filed Jul. 30, 2010, the entirety of which is incorporated by reference.

FIELD

This invention relates to purification of a feedstream to a process for the production of xylenes by transalkylation of stream comprising C9+ aromatic hydrocarbons with at least one of benzene and toluene.

BACKGROUND

An important source of xylene in an oil refinery is catalytic reformate, which is prepared by contacting a mixture of petroleum naphtha and hydrogen with a strong hydrogenation/dehydrogenation catalyst, such as platinum, on a moderately acidic support, such as a halogen-treated alumina. Usually, a C6 to C8 fraction is separated from the reformate and extracted with a solvent selective for aromatics or aliphatics to produce a mixture of aromatic compounds that is relatively free of aliphatics. This mixture of aromatic compounds usually contains benzene, toluene and xylenes (BTX), along with ethylbenzene.

However, the quantity of xylene available from reforming is limited and so recently refineries have also focused on the production of xylene by transalkylation of $C_9$+ aromatic hydrocarbons (or simply "A9+") with benzene and/or toluene over noble metal-containing zeolite catalysts. By way of example, U.S. Pat. No. 5,030,787 teaches using MCM-22 as the zeolite catalyst for transalkylation. Numerous modifications of transalkylation reactions are described in the prior art, such as U.S. Application Publication No. 2010-0298117 and U.S. application Ser. Nos. 12/973,358 and 12/973,331 and references cited therein.

The present inventors have discovered that when processing higher aromatic hydrocarbon content feeds in a transalkylation reaction systems that chlorides accumulate on the catalyst during the cycle to levels exceeding 500 ppmw. When the catalyst is then regenerated by oxygen burn some of the chlorides are released and can concentrate in the regeneration water that condenses in the effluent product cooler and high pressure separator. These chlorides, as HCl, lower the water condensate pH to levels as low as 2.5 causing potential corrosion of carbon steels and the chloride ions in the aqueous solution can also cause stress corrosion cracking of stainless steels. The source of the chloride impurities (or more generally halide and/or halogen impurities) can be from one or more of the hydrocarbon feed sources, the hydrogen make up feed, or a combination thereof. In particular, without wishing to be bound by theory, it is believed that at least one source of the chlorides comes from the feed component(s) which originate from the naphtha reformer, which uses chlorine (and possibly other halogen species) for catalyst activity maintenance. By way of example, chloride levels in the aromatic feed on the order of 100 ppb or less can result in the levels observed in excess of 500 ppmw on the spent coked catalyst over a 1-2 year cycle if all the chloride in the feed is absorbed. We have also found that higher levels of chlorides on regenerated catalyst can be detrimental to the catalyst's second cycle aging performance.

U.S. Pat. No. 7,154,014 teaches that deactivating contaminants present in typical hydrocarbon feeds, such as chlorides, can be removed with a gamma alumina guard bed prior to contacting with a transalkylation catalyst, particularly those having a solid-acid component such as mordenite, and a metal component such as rhenium. The invention suggests that the feed needs to be heated prior to dechlorination guard bed. The requirement of heat and the showing that gamma alumina (activated and high surface area) is superior to alpha alumina (inactive and low surface area) suggests a catalytic function to the guard bed. See also U.S. Patent Application No. 20070086933 and U.S. Pat. No. 7,307,034.

These solutions do not address all of the problems noted by the present inventors and in addition suggests use of the heat generated in the transalkylation reactor to heat the feed to the guard bed. Such heat is at a premium in chemical and refinery operations and is better used elsewhere. Furthermore the suggestion of a catalytic function of the guard bed could give unpredictable results depending on the source of the feed and attendant impurities.

The present invention solves these problems by removing the chlorides from the feed by removing chlorides from the stream before the feed enters the reactor using a guard bed different from that suggested in the prior art and that can operate at ambient temperature, without the need for heat input.

SUMMARY

An absorber suitable for absorbing and/or otherwise removing halides and/or halogen species from a feedstream at ambient conditions is placed upstream of a transalkylation reactor to absorb and/or otherwise remove chlorides prior to a contacting step, wherein a C9+ aromatic hydrocarbon feedstream with a C6 and/or C7 aromatic hydrocarbon feedstream are contacted with a catalyst comprising molecular sieves under conversion conditions to provide a product having an increased amount of xylenes and a decreased concentration of halides and/or halogen species, when compared with the concentration of halides and/or halogen species in such a process without said absorber.

The absorber preferably comprises a bed of molecular sieves but may also be any process that removes halides and/or halogen species, particularly chlorides, such as a water wash, or caustic wash followed by a water wash and drying step. The absorber is preferably sized to absorb all the entering halides and/or halogen species for a predetermined cycle length of the transalkylation reactor catalyst bed. Alternatively, parallel absorbers may be employed, allowing for regenerating one or more absorbers while one or more other absorbers are in service.

In an embodiment the absorber is placed upstream of the reactor so as to remove chlorides and other halide and/or halogen species from the C9+ aromatic feedstream or the C6 and/or C7 feedstream, prior to merging, or it can contact the combined feedstream of aromatic hydrocarbons, or it can contact the hydrogen make up stream, or a combination thereof.

The invention is also directed to a catalyst system adapted for the above processes, particularly wherein the absorber system is not thermally coupled with the transalkylation reactor.

It is an object of the invention to provide a process for transalkylation characterized by at least one of (a) improved catalyst performance, particularly an improvement from one cycle to another, through an intermediate step of regeneration of the catalyst; and (b) improved downstream performance, particularly with respect to corrosion of equipment.

It is further an object of the present invention to provide, in embodiments using a multiple bed catalyst system, an aromatic transalkylation process that retains the advantages of the multiple bed catalyst system while reducing the problem of aromatic saturation.

It will be understood by one of skill in the art in possession of the present disclosure that combinations and variations on the aforementioned embodiments and objects are also possible, e.g., with respect to embodiments, more than one absorber type may be used, and with respect to objects, that the transalkylation heat of reaction is better used elsewhere in the chemical and/or refinery plant.

DETAILED DESCRIPTION

Figure 1:
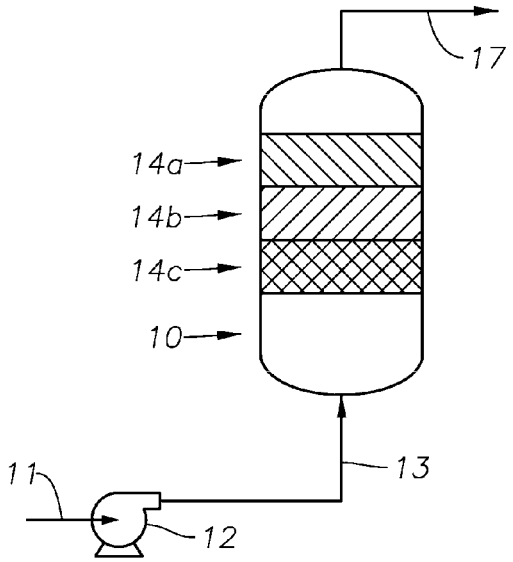
FIGS. 1-3 are schematics showing embodiments of a chloride absorber according to the present invention.

An absorber suitable for absorbing and/or otherwise removing halides and/or halogen species is placed upstream of a transalkylation reactor for the purpose of substantially removing chlorides and other halide and/or halogen species from one or more feedstreams to said reactor.

The absorber can operate at ambient temperature, meaning that heat neither needs be supplied or removed from the system, nor does the feed to the absorber need to be heated or cooled prior to contact with the absorber system, and thus the absorber and transalkylation reactor do not need to be thermally coupled. As a result, the heat from the transalkylation reactor may be used outside of the system described herein. This also simplifies the apparatus and more readily allows retrofitting of a transalkylation reactor system. In embodiments, the absorber will operate at a temperature of between the freezing point of the benzene and/or toluene-containing feed and 190° C., or between zero and 100° C., or between 10 and 50° C., or between any lower temperature to any higher temperature listed here.

Described herein is a process for producing xylene by transalkylation of a heavy aromatic hydrocarbon feedstock with toluene and/or benzene in the presence of hydrogen and a suitable catalyst, wherein at least one of the streams of aromatic reactants and/or hydrogen source comprises chlorides and/or other halogen and/or halide species. The term "chlorides" is used because that is how the impurities typically are tested on the catalyst, however the actual source of Cl can be chlorides such as HCl or chlorohydrocarbon species. The chlorides and/or other halide and/or halogen species are substantially removed prior to contact with the suitable catalyst in the transalkylation reactor by an absorber.

As described more fully below, there are various types of absorbers per se known that are useful in the present invention, such as molecular sieves, water wash, caustic wash and the like. With regard to molecular sieves, one skilled in the art in possession of the present disclosure can select the appropriate molecular sieve (or water wash or caustic wash) useful in the present invention, that will absorb or otherwise remove chloride and other halide and/or halogen species down to very low, negligible levels, or even no detectable levels of chloride on the catalyst after at least a cycle time of one year. Appropriate molecular sieves include molecular sieve 4A, Selexsorb™ CD, molecular sieve 13×, all per se well known and commercially available. By "no detectable levels of chloride" means no detectable levels by routine means of analysis, for instance XRF (X-Ray Fluorescence) analysis. Without wishing to be bound by theory, while the exact mechanism by which chloride and other halide and/or halogen species is removed is not critical, e.g., chemisorption or physisorption or a combination thereof, or some other mechanism, the object is to prevent said halide and/or halogen species from collecting on the transalkylation catalyst in a manner that, when the catalyst is regenerated, it is passed downstream from the reactor.

In an embodiment of the invention, the invention comprises a process for producing xylene by transalkylation of a C9+ aromatic hydrocarbon feedstock with a C6 and/or C7 aromatic hydrocarbon feedstock, and a system adapted therefore, the process comprising:

(a) providing a C9+ aromatic hydrocarbon stream, a C6 and/or C7 aromatic hydrocarbon stream, and a hydrogen gas stream to a transalkylation reaction system comprising a transalkylation reactor and at least one absorber suitable for absorbing chlorides and other halide and/or halogens from at least one of said streams at ambient conditions, with the proviso that at least one of said streams is treated with said absorber to substantially remove chlorides and other halides and/or halogens therefrom prior to step (b); and then (b) contacting at least a portion of each of said streams (the C9+ aromatic hydrocarbon stream, the C6 and/or C7 aromatic hydrocarbon stream, and the hydrogen gas stream) with a first catalyst under conditions effective to dealkylate aromatic hydrocarbons in the feedstock containing C2+ alkyl groups and to saturate C2+ olefins formed so as to produce a first effluent, the first catalyst comprising (i) a first molecular sieve having a Constraint Index in the range of about 3 to about 12 and (ii) at least a first and optionally a second different metal, or compounds thereof, from Groups 6 to 12 of the Periodic Table of the Elements; and then (c) contacting at least a portion of said first effluent with a second catalyst comprising a second molecular sieve having a Constraint Index less than 3 under conditions effective to transalkylate C9+ aromatic hydrocarbons with said at least one C6 and/or C7 aromatic hydrocarbon to form a second effluent comprising xylene. Xylene may then be recovered downstream and/or sent to further processing. Hydrogen gas is typically recovered and sent as recycle gas, combined with hydrogen make up gas either before or after the recycle gas compressor, depending on the supply pressure and other equipment limitations. The total gas is then combined with the other streams to the transalkylation reactor.

The transalkylation reaction system according to the present invention, such as described immediately above with respect to a specific embodiment, may also be described as consisting essentially of the transalkylation reactor and halide/halogen species absorber. While other apparatus would also be associated with this system that do not affect the characteristics of the present invention, such as compressors and valves, as would be recognized by one of ordinary skill in the art, it is important to distinguish this system from other steps that might occur also upstream from a transalkylation reactor in a chemical or petrochemical plant. For instance, from time to time various treatments with molecular sieves are used for purposes other than removal of halide and/or halogen species. By way of example, certain molecular sieves are used to improve the Bromine Index of certain streams by removal of olefins. However, such a system would not be suitable for removal of halide and/or halogen species that accumulate on the transalkylation catalyst system(s)

according to the present invention, and thus would not be useful in carrying out one of the objects of the invention, which is to provide a guard system so that there is no detectable accumulation of halide and/or halogen species on the transalkylation catalyst for at least one year cycle time and preferably at least two years cycle time.

In preferred embodiments of the above embodiment steps (a) through (c), the first metal on the catalyst in step (b) is at least one of platinum, palladium, iridium, and rhenium and the second metal, when present, is at least one of copper, silver, gold, ruthenium, iron, tungsten, molybdenum, cobalt, nickel, tin and zinc. In a preferred embodiment, the first metal comprises platinum and said second metal, when present, comprises copper and/or silver. In some embodiments the second metal is present and in other embodiments the second metal is not present.

In preferred embodiments of the above embodiments steps (a) through (c), the first metal on the catalyst in step (b) is present in the first catalyst in an amount between about 0.001 and about 5 wt % of the first catalyst and the second metal, if present in the first catalyst, is present in an amount between about 0.001 and about 10 wt % of the first catalyst.

In preferred embodiments, the first molecular sieve in step (b), above, comprises at least one of ZSM-5, ZSM-11, ZSM-22, ZSM-23, ZSM-35, ZSM-48, ZSM-57 and ZSM-58.

In preferred embodiments, the second molecular sieve in step (b), above, comprises at least one of zeolite beta, zeolite Y, UltrastableY (USY), DealuminizedY (DealY), mordenite, NU-87, ZSM-3, ZSM-4 (Mazzite), ZSM-12, ZSM-18, MCM-22, MCM-36, MCM-49, MCM-56, EMM-10, EMM-10-P and ZSM-20.

In one preferred embodiment of the above embodiments (a) through (c), the said first molecular sieve is ZSM-5 and the second molecular sieve is ZSM-12.

In preferred embodiments of the embodiments (a) through (c), above, the first molecular sieve in step (b) has an alpha value in the range of 100 to 1500 and the second molecular sieve has an alpha value in the range of 20 to 500.

In preferred embodiments, the second catalyst in step (c), above, also comprises the same first and second metals or compounds thereof as the first catalyst. In a particularly preferred embodiment the second catalyst in step (c), above, is further characterized as comprising up to 5 wt % of at least one metal selected from Groups 6-10 of the Periodic Table, based on the weight of the second catalyst. The metal may be present in the form of a compound of said metal, in which case the wt % is based on the amount of metal in said compound.

In preferred embodiments, the weight ratio of the first catalyst in step (b), above, to the second catalyst in step (b), above, is in the range of 5:95 to 75:25.

While suitable contacting conditions for all the steps in the process described in the embodiments (a) through (c), above, may be determined by one skilled in the art in possession of the present disclosure, in certain preferred embodiments, the conditions employed in the contacting (b) and (c) comprise a temperature in the range of about 100 to about 800° C., a pressure in the range of about 790 to about 7000 kPa-a, a $H_2$:HC molar ratio in the range of about 0.01 to about 20, and a WHSV in the range of about 0.01 to about 100 $hr^{-1}$. In the case where steps (b) and (c) occur in the same bed, the conditions in the beds will be essentially the same but in the case where the steps (b) and (c) are in different beds the conditions may be separately and independently selected. As for the conditions of the one or more absorbers used in step (a), it is an advantage of the present invention that no special heating, cooling, or pressure conditions need be specified and the conditions may therefore be termed "ambient".

In preferred embodiments of steps (a) through (c), above, the process further comprises:

(d) contacting at least a portion of said second effluent comprising xylene with a third catalyst comprising a third molecular sieve having a Constraint Index in the range of about 3 to about 12 under conditions effective to crack non-aromatic cyclic hydrocarbons in said second effluent and form a third effluent comprising xylene; and (e) recovering xylene from said third effluent.

In another embodiment, the invention concerns in a catalyst system adapted for transalkylation a C9+ aromatic hydrocarbon feedstock with an aromatic hydrocarbon feedstock comprising at least one of C6 and C7 aromatic hydrocarbons, the catalyst system comprising:

(a) a chloride absorber, upstream from and fluidly connected with (b) a first catalyst bed comprising (i) a first molecular sieve having a Constraint Index in the range of about 3 to about 12 and (ii) at least first and second different metals or compounds thereof of Groups 6 to 12 of the Periodic Table of the Elements having different benzene saturation activity; and (c) a second catalyst bed comprising a second molecular sieve having a Constraint Index less than 3;

wherein the weight ratio of said first catalyst to said second catalyst is in the range of about 5:95 to about 75:25 and wherein said first catalyst bed is located upstream of said second catalyst bed when the catalyst system is brought into contact with said C9+ aromatic hydrocarbon feedstock and said C6-C7 aromatic hydrocarbon in the presence of hydrogen; and (d) optionally contacting at least a portion of the effluent from (c) with a third catalyst comprising a third molecular sieve having a Constraint Index in the range of about 3 to about 12 under conditions effective to crack non-aromatic cyclic hydrocarbons in said second effluent and form an effluent comprising xylene.

The present invention is also directed to an apparatus or system adapted for the above embodiments, wherein said system comprises an absorber for chlorides and other halide and/or halogen species and at least two, and optionally three, catalyst beds which are arranged so that the absorber is located upstream of the transalkylation reactor, and wherein the transalkylation reactor comprises a first catalyst bed located upstream of the second catalyst bed and, if present, the third catalyst bed is located downstream of the second catalyst bed, when the catalyst system is brought into contact with the heavy aromatic hydrocarbon feedstock and the C6 and/or-C7 aromatic hydrocarbon in the presence of hydrogen. The absorber is effective to remove substantially all of the chloride and/or other halogen and/or halide species in at least one of the feedstreams to the transalkylation reactor. The first catalyst is effective to dealkylate aromatic hydrocarbons in the heavy aromatic feedstock containing C2+ alkyl groups and to saturate the resulting C2+ olefins. The second catalyst is effective to transalkylate the heavy aromatic hydrocarbons with the C6 and/or C7 aromatic hydrocarbon to produce xylenes. The optional third catalyst bed is effective to crack non-aromatic cyclic hydrocarbons in effluent from the first and second catalyst beds.

Further preferred embodiments of the transalkylation system and process downstream of the absorber step (a) in the above embodiments may be found in U.S. Pat. No. 7,663,010.

In another embodiment, the invention comprises a process for producing xylene by transalkylation of a C9+ aromatic hydrocarbon feedstock with a C6 and/or C7 aromatic hydrocarbon feedstock, and a system adapted therefore, the process comprising:

(a) providing a C9+ aromatic hydrocarbon stream, a C6 and/or C7 aromatic hydrocarbon stream, and a hydrogen gas stream to a transalkylation reaction system comprising a transalkylation reactor and at least one absorber suitable for absorbing chlorides and other halide and/or halogens from at least one of said streams at ambient conditions, with the proviso that at least one of said feedstocks is treated by said absorber to substantially remove chlorides and other halide and/or halogens prior to step (b); and then (b) contacting at least a portion of each of said streams in step (a) together with a first catalyst composition comprising a zeolite having a Constraint Index ranging from 0.5 to 3 and a hydrogenation component under suitable transalkylation conditions, and then optionally a second catalyst composition comprising an intermediate pore size zeolite having a Constraint Index ranging from 3 to 12 and a silica to alumina ratio of at least about 5, under conditions suitable to convert undesired C6 and C7 non-aromatics.

The invention is further directed to a system or apparatus adapted to practicing the embodiment described immediately above.

Preferred embodiments of the first and second catalyst compositions and further variations in this embodiment are described more fully in U.S. Pat. No. 5,942,651.

Regarding feedstocks, as used herein the term "Cn+", wherein n is a positive integer, means a compound or group containing at least n carbon atoms. In addition, the term "Cn+" aromatic hydrocarbon feedstock, wherein n is a positive integer, means that a feedstock comprising greater than 50 wt % of aromatic hydrocarbons having at least n number of carbon atom(s) per molecule.

Thus the C9+ feedstock used in the present process comprises greater than 50 wt %, conveniently at least 80 wt %, typically at least 90 wt %, of one or more aromatic compounds containing at least 9 carbon atoms. Specific C9+ aromatic compounds found in a typical feed include mesitylene (1,3,5-trimethylbenzene), durene (1,2,4,5-tetramethylbenzene), hemimellitene (1,2,4-trimethylbenzene), pseudocumene (1,2,4-trimethylbenzene), ethyltoluenes, ethylxylenes, propyl-substituted benzenes, butyl-substituted benzenes, and dimethylethylbenzenes. Suitable sources of the C9+ aromatics are any C9+ fraction from any refinery process that is rich in aromatics, such as catalytic reformate, FCC naphtha or TCC naphtha.

The feed to the process also includes benzene and/or toluene, typically toluene. The feed may also include unreacted toluene and C9+ aromatic feedstock that is recycled after separation of the xylene product from the effluent of the transalkylation reaction. Typically, the C6 and/or C7 aromatic hydrocarbon constitutes up to 90 wt %, such as from 10 to 70 wt % of the entire feed, whereas the C9+ aromatics component constitutes at least 10 wt %, such as from 30 to 85 wt %, of the entire feed to the transalkylation reaction.

The feedstock may be characterized by the molar ratio of methyl groups to single aromatic rings. In some embodiments, the combined feedstock (the combination of the C9+ and the C6 and/or C7 aromatic feedstocks) has a molar ratio of methyl groups to single aromatic rings in the range of from 0.5 to 4, such as from 1 to 2.5, for example from 1.5 to 2.25.

Additional details of the transalkylation catalyst system may be found in the patents and patent applications described in the Background section above, in addition to the previously mentioned U.S. Pat. Nos. 5,942,651 and 7,663,010, and also U.S. Pat. Nos. 6,864,203; 6,893,624; 7,485,765; 7,439,204; 7,553,791; and 5,763,720.

At least one of the feedstocks is further characterized as comprising chlorides, which may be present as inorganic or organic species, e.g., HCl or chlorohydrocarbon species. It will be recognized by one skilled in the art in possession of the present disclosure that what we are trying to avoid, more generally, is the accumulation on the transalkylation catalyst of halides and halogens. As previously mentioned, among other reasons for avoiding said accumulation is that on regeneration, particularly regeneration using a method comprising an oxygen burn, chlorides (or other halogen and/or halide species) can be released downstream, causing negative consequences that should be avoided.

The invention can be understood by reference to the accompanying drawings showing embodiments of the invention. It will be understood that these embodiments are merely representative of the invention, and should not be taken as limiting. Numerous modifications would be readily apparent to one of ordinary skill in the art in possession of the present disclosure.

FIG. 1 is a schematic showing an absorber or guard bed 10 suitable for removing chlorides and/or other halide and/or halogen species, is upstream of a transalkylation reactor (not shown). Feed 11 comprising C9+ aromatic hydrocarbons and at least one of benzene and toluene are fed through conduit 11 with the aid of pump 12, entering apparatus 10 through conduit 13. The chloride absorber (or more generally halide/halogen absorber) 10 comprises plural beds 14*a*, 14*b*, and 14*c*. Although heating or cooling means may be provided either directly to apparatus 10 by heat exchange or upstream of 10 such as by heat exchange to conduit 13, one of the advantages of the present invention is that the chloride absorber of the present invention, comprising, in an embodiment, molecular sieves, may operate at ambient temperature in the liquid phase. In an embodiment, each of plural beds 14*a* through 14*c* may be different or they may be the same. For instance, be 14*c* may comprise 4A molecular sieves, 14*b* comprises 13× molecular sieves, and 14*c* comprises Selexsorb™ CD. Each of these sieves is commercially available and well-known per se. The ratio of the volume of the various beds may be determined by one of skill in the art. In an embodiment, when three layers are used, such as in FIG. 1, the ratio is conveniently approximately 33 vol %:33 vol %:33 vol %. The total volume of the absorber is conveniently selected to be sufficient to absorb substantially all the chloride impurities (and preferably substantially all the other halide and/or halogen species) in the cycle, which may be predetermined by one of skill in the art. The thus-treated feed is then conveyed through conduit 17 to the transalkylation reactor.

In an experimental run using a transalkylation feed contacting a commercial transalkylation catalyst using the absorber as described above for FIG. 1 upstream of said transalkylation catalyst, wherein each molecular sieve bed in the absorber is approximately 2 cm deep and 0.6 cm inner diameter, no detectable chloride was found on the spent catalyst following an approximately 1 year cycle run. In contrast, a commercial run without the guard bed using the same feed and the same catalyst, the catalyst was found to have >500 ppmw chloride after the same cycle time. On regeneration of the catalyst used in the commercial run, the regeneration gas water condensate had a pH of 2.5.

Figure 2:
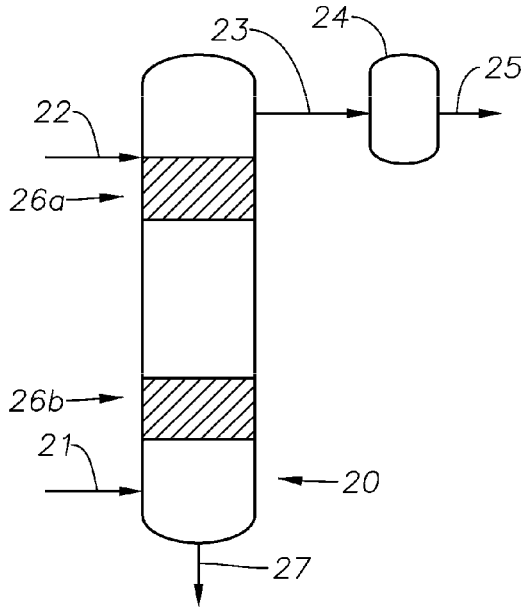

An alternative embodiment is shown in the schematic illustrated in FIG. 2. FIG. 2 shows water wash tower 20. Wash tower 20 may be configured according to a typical distillation tower, comprising trays (not shown) and/or various beds of packing, such as shown in FIG. 2 by elements 26*a* and 26*b*. These per se are well-known in the art. The appropriate aromatic hydrocarbon feed enters the wash through conduit 21 near the bottom of the column 20 and is washed with an aqueous solution entering near the top of the column through conduit 22. Water containing chlorides is sent out the bottoms 27 and the thus-dechlorinated aromatic feedstream is conveyed via conduit 23 to be dried, such as over 4A sieves in dryer 24 and then sent to the transalkylation reactor via conduit 25.

Again, as in the embodiment, shown in FIG. 1, no heat exchange is necessary and the dechlorination may be performed in the wash tower 20 of FIG. 2 at ambient conditions. One of skill in the art will recognize that the feed is typically heated prior to contacting the catalyst in the transalkylation apparatus, so in the case of adding the absorber of the present invention by retrofitting, no additional heating and/or cooling devices are needed, as there is no need for exchange of heat between the reactor and absorber, and in fact no need to supply (or remove) heat at all, in contrast to prior art systems.

Figure 3:
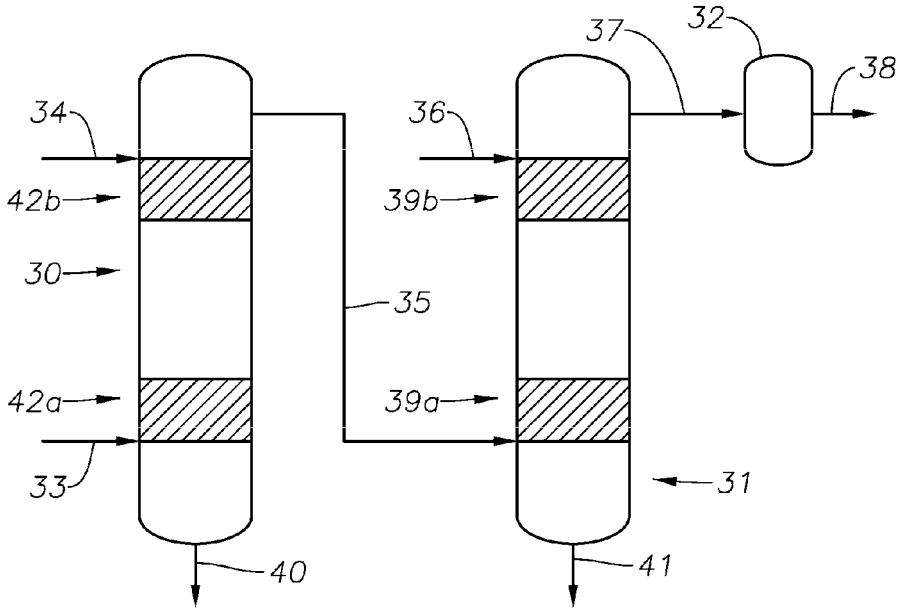

Yet another alternative embodiment of the invention is shown in the schematic illustrated in FIG. 3. FIG. 3 shows a caustic absorber tower 30 in series and upstream from wash tower 31, in series and upstream from dryer 32. The aromatic hydrocarbon feed comprising A9+ species and at least one of benzene and toluene enters the caustic absorber tower 30 near the bottom through conduit 33, which may contain various trays and packings such as the packing illustrated by areas 42*a* and 42*b*. Spent caustic is sent to a regeneration step (not shown) per se know in the art, via bottoms conduit 40 and the overheads aromatic hydrocarbon feed is sent to water wash tower 31, which may comprise various trays and packings such as illustrated by areas 39*a* and 39*b*. As in FIG. 2, water enters the wash tower near the top such as through conduit 36 of FIG. 2. Water is sent to treatment via bottoms conduit 41 and the overhead de-chlorinated aromatic hydrocarbon stream is sent to a dryer 32 via conduit 37 and then to the transalkylation reactor (not shown) via conduit 38.

All patents, patent applications, test procedures, priority documents, articles, publications, manuals, and other documents cited herein are fully incorporated by reference for all jurisdictions in which such incorporation is permitted. When numerical lower limits and numerical upper limits are listed herein, ranges from any lower limit to any upper limit are contemplated. All terms should take their ordinary meaning in the art unless explicitly defined otherwise herein. When the meaning of a term is still in doubt reference should be made to the prior art cited herein, particularly first to U.S. Pat. Nos. 5,942,651 and 7,663,010, and then to patents cited in the Detailed Description of the Invention section, then to references cited in the Background section, and then to Handbook of Petroleum Refining Processes, Third Edition, Robert A. Meyers, Editor, Copyright 2004, and then to Webster's Collegiate Dictionary, Fourth Edition, Copyright 2004.

While the illustrative embodiments of the invention have been described with particularity, it will be understood that various other modifications will be apparent to and may be readily made by those skilled in the art without departing from the spirit and scope of the invention.

The invention claimed is:

1. A process for producing xylenes by transalkylation of a feed comprising C9+ aromatic hydrocarbon and at least one of C6 and C7 aromatic hydrocarbon, by contact of said feed and hydrogen, optionally provided at least in part by a hydrogen make up stream, with a suitable transalkylation catalyst under suitable transalkylation conditions to produce xylenes, the improvement comprising passing at least one of (i) said feed or a component of said feed selected from the group consisting of C9+ aromatic hydrocarbon, C6 aromatic hydrocarbon, C7 aromatic hydrocarbon, and mixtures thereof, and (ii) said hydrogen make up stream, through an absorber, at ambient conditions and upstream of said contact, said absorber characterized as suitable for absorbing, at said ambient conditions, substantially all of any chloride and/or other halogen and/or halide species in said feed, said component of said feed and/or said make up source of hydrogen;

further characterized by:

(a) contacting said feed and said hydrogen, downstream of said absorber, with a first catalyst in the presence of hydrogen under conditions effective to dealkylate aromatic hydrocarbons in the feedstock containing C2+ alkyl groups and to saturate C2+ olefins formed so as to produce a first effluent, the first catalyst comprising (i) a first molecular sieve having a Constraint Index in the range of about 3 to about 12 and (ii) at least one first metal or compound thereof of Groups 6 to 12 of the Periodic Table; and then (b) contacting at least a portion of said first effluent with a second catalyst comprising a second molecular sieve having a Constraint Index less than 3 under suitable transalkylation conditions effective to transalkylate C9+ aromatic hydrocarbons with said at least one C6-C7 aromatic hydrocarbon to form a second effluent comprising xylene; and then (c) contacting at least a portion of said second effluent comprising xylene with a third catalyst comprising a third molecular sieve having a Constraint Index in the range of about 3 to about 12 under conditions effective to crack non-aromatic cyclic hydrocarbons in said second effluent and form a third effluent comprising xylene; and (d) recovering xylene from said third effluent.

2. The process according to claim 1, wherein said absorber is selected from at least one of the group consisting of (i) a bed of molecular sieves, (ii) a wash tower, and (iii) a caustic tower, whereby said species are substantially removed from said feed or component of said feed or make up source of hydrogen upstream of said contact.

3. The process of claim 1, wherein said at least one first metal is selected from at least one of platinum, palladium, iridium, and rhenium.

4. The process of claim 3, further including at least one second metal or compound thereof on said first molecular sieve, selected from at least one of copper, silver, gold, ruthenium, iron, tungsten, molybdenum, cobalt, nickel, tin and zinc.

5. The process of claim 1, wherein said first metal comprises platinum and wherein said first catalyst further comprises copper.

6. The process of claim 5, wherein the first metal is present in the first catalyst in an amount between about 0.001 and about 5 wt % of the first catalyst.

7. The process of claim 6, further comprising a second metal in the first catalyst in an amount between about 0.001 and about 10 wt % of the first catalyst.

8. The process of claim 1, wherein said first molecular sieve comprises at least one of ZSM-5, ZSM-11, ZSM-22, ZSM-23, ZSM-35, ZSM-48, ZSM-57 and ZSM-58.

9. The process claim 8, wherein said second molecular sieve comprises at least one of zeolite beta, zeolite Y, Ultrastable Y (USY), Dealuminized Y (Deal Y), mordenite, NU-87, ZSM-3, ZSM-4 (Mazzite), ZSM-12, ZSM-18, MCM-22, MCM-36, MCM-49, MCM-56, EMM-10, EMM-10-P and ZSM-20.

10. The process of claim 1, wherein said first molecular sieve is ZSM-5 and said second molecular sieve is ZSM-12.

11. The process of claim 10, wherein said ZSM-5 has a particle size of less than 1 micron, and said ZSM-12 has a particle size of less than 0.5 micron.

12. The process of claim 11, wherein said ZSM-5 has an alpha value in the range of 100 to 1500, and wherein said ZSM-12 has an alpha value in the range of 20 to 500.

13. The process of claim 1, wherein the weight ratio of the first catalyst to the second catalyst is in the range of 5:95 to 75:25.

14. The process of claim 1, wherein the contacting (a) and (b) are conducted in a single reaction zone.

15. The process of claim 14, wherein the conditions employed in the contacting (a) and (b) include a temperature in the range of about 100 to about 800° C., a pressure in the range of about 790 to about 7000 kPa-a, a $H_2$:HC molar ratio in the range of about 0.01 to about 20, and a WHSV in the range of about 0.01 to about 100 $hr^{-1}$.

16. The process of claim 1, wherein said first catalyst bed is maintained under conditions effective to dealkylate aromatic hydrocarbons containing C2+ alkyl groups in the feedstock and to saturate the resulting C2+ olefins, said conditions including a temperature in the range of about 100 to about 800° C., a pressure in the range of about 790 to about 7000 kPa-a, a $H_2$:HC molar ratio in the range of about 0.01 to about 20, and a WHSV in the range of about 0.01 to about 100 $hr^{-1}$; and wherein said second catalyst bed is maintained under conditions effective to transalkylate C9+ aromatic hydrocarbons with said at least one C6-C7 aromatic hydrocarbon, said conditions including a temperature in the range of about 100 to about 800° C., a pressure in the range of about 790 to about 7000 kPa-a, a $H_2$:HC molar ratio in the range of about 0.01 to about 20, and a WHSV in the range of about 0.01 to about 100 $hr^{-}$; and wherein said the third catalyst bed is maintained under conditions effective to crack non-aromatic cyclic hydrocarbons in the effluent from the second catalyst bed, said conditions including a temperature in the range of about 100 to about 800° C., a pressure in the range of about 790 to about 7000 kPa-a, a $H_2$:HC molar ratio in the range of about 0.01 to about 20, and a WHSV in the range of about 0.01 to about 100 $hr^{-1}$.

17. A process according to claim 1, wherein xylene is produced for a cycle time of at least one year and resulting in the production of a spent coked transalkylation catalyst, said spent coked catalyst characterized by having less than 10 ppm of chloride by XRF analysis.

18. A process according to claim 1, wherein the first catalyst is ZSM-5, and the second catalyst is ZSM-12.

19. A process according to claim 18, wherein said absorber is a bed of molecular sieves.

20. A process according to claim 1, wherein said absorber is a bed of molecular sieves, said first catalyst is ZSM-5 further comprising platinum and at least one of silver and copper, and the second catalyst is ZSM-12.

* * * * *